US005480470A

United States Patent [19]

Miller et al.

[11] Patent Number: 5,480,470

[45] Date of Patent: Jan. 2, 1996

[54] ATOMIZATION WITH LOW ATOMIZING GAS PRESSURE

[75] Inventors: Steven A. Miller, Amsterdam, N.Y.; Roy W. Christensen, North Borough; David P. Mourer, Danvers, both of Mass.

[73] Assignee: General Electric Company, Schenectady, N.Y.

[21] Appl. No.: 259,103

[22] Filed: Jun. 13, 1994

Related U.S. Application Data

[63] Continuation of Ser. No. 961,942, Oct. 16, 1992, abandoned.

[51] Int. Cl.[6] ..... B22F 9/08

[52] U.S. Cl. ..... 75/338; 264/12

[58] Field of Search ..... 75/338, 339; 264/12

[56] References Cited

U.S. PATENT DOCUMENTS

| | | | |
|---|---|---|---|
| 3,817,503 | 6/1974 | Lafferty et al. | 425/7 |
| 3,988,084 | 10/1976 | Esposito et al. | 425/7 |
| 4,272,463 | 6/1981 | Clark et al. | 264/12 |
| 4,575,325 | 3/1986 | Duerig et al. | 425/7 |
| 4,578,022 | 3/1986 | Kenney | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,778,516 | 10/1988 | Raman | 425/7 |
| 4,801,412 | 1/1989 | Miller | 264/12 |
| 4,999,051 | 3/1991 | Yolton et al. | 75/338 |

OTHER PUBLICATIONS

"Atomization of Specialty Alloy Powders", A. Lawley, Journal of Metals, Jan., 1981, pp. 13–18.

"Particle Size Measurement of Inert–gas–atomized Powder", F. S. Biancaniello, J. J. Conway, P. I. Espina, G. E. Mattingly, S. D. Ridder, Materials Science and Engineering, A124 (1990), pp. 9–14.

"Powder Size and Distribution in Ultrasonic Gas Atomization", F. Rai, E. Lavernia, N. J. Grant, Journals of Metals, Aug., 1985, pp. 22–26.

"Rapid Solidification of a Modified 7075 Aluminum Alloy by Ultrasonic Gas Atomization", V. Anand, A. J. Kaufman, N. J. Grant, Proc. Int'l. Conf. Rapid Solidification Processing, Mar., 1980, pp. 273–286.

"Rapidly Solidified Aluminum Alloy Powder Produced by Optimization of the Gas Atomization Technique", M. J. Couper, R. F. Singer, Proc. Int'l. Conf. Rapidly Quenched Metals, Sep. 3–7, 1984, pp. 1737–1742.

*Primary Examiner*—George Wyszomierski

*Attorney, Agent, or Firm*—R. Thomas Payne; James Magee, Jr.

[57] ABSTRACT

A method for atomizing high temperature melts to achieve greater efficiency and smaller particle size is described. The method involves the employment of lower pressure gas coupled with an atomization nozzle larger than prior art structures. The atomization nozzle is part of a close coupled atomization structure having shallow depth dimension. The method allows atomization at melts with reduced likelihood of freeze off. The method reduces heat extraction from the melt while the melt is still contained in the atomization nozzle.

21 Claims, 5 Drawing Sheets

ATOMIZATION WITH LOW ATOMIZING GAS PRESSURE

CROSS-REFERENCE TO RELATED APPLICATIONS

This application is a continuation of application Ser. No. 07/961,942, filed Oct. 16, 1992, abandoned.

The present invention relates closely to commonly owned applications:

Ser. No. 07/920,075, filed Jul. 27, 1992;

Ser. No. 07/920,066, filed Jul. 7, 1992;

Ser. No. 07/920,067, filed Jul. 7, 1992;

Ser. No. 07/928,581, filed Aug. 13, 1992;

Ser. No. 07/928,596, filed Aug. 13, 1992;

Ser. No. 07/898,609, filed Jun. 15, 1992;

Ser. No. 07/928,595, filed Aug. 13, 1992;

Ser. No. 07/898,602, filed Jun. 15, 1992; and

Ser. No. 07/928,385, filed Aug. 12, 1992.

BACKGROUND OF THE INVENTION

The present invention relates generally to closely coupled gas atomization. More particularly, it relates to methods and means by which closely coupled gas atomization processing of high melting reactive molten metal can be started and carried out with significantly reduced melt superheat.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt orifice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in precipitated form.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the atomization process. This is particularly true for the finer particles of the powder formed from the atomization.

In this regard, it is known that the rate of cooling of a molten particle of relatively small size in a convective environment such as a flowing fluid or body of fluid material is determined by the properties of the droplet and of the cooling fluid. For a given atomization environment, that is one in which the gas, alloy, and operating conditions are fixed, the complex function relating all the properties can be reduced to the simple proportionality involving particle size shown below, $$\dot{T}_p \alpha \frac{1}{D_p^2},$$

where:

$\dot{T}_p$=cooling rate, and $D_p$=droplet diameter.

Simply put, the cooling rate for a hot droplet in a fixed atomization environment is inversely proportional to the diameter squared. Accordingly, the most important way to increase the cooling rate of liquid droplets is to decrease the size of the droplets. This is the function of effective gas atomization.

Thus it follows that if the average size of the diameter of a droplet of a composition is reduced in half, then the rate of cooling is increased by a factor of about 4. If the average diameter is reduced in half again, the overall cooling rate is increased 16 fold.

Since high cooling rates are predominantly produced by reducing droplet size, it is critical to effectively atomize the melt.

The Weber number, We, is the term assigned to the relationship governing droplet breakup in a high velocity gas stream. The Weber number may be calculated from the following expression:

$$We = \frac{\rho V^2 D}{\sigma}$$

where $\rho$ and V are the gas density and velocity, and $\sigma$ and D are the droplet surface tension and diameter.

When the We number exceeds ten, the melt is unstable and will break up into smaller droplets. The dominant term in this expression is gas velocity and thus in any atomization process it is essential to have high gas velocities. As described in the commonly owned U.S. Pat. No. 4,631,013 the benefit of close coupling is that it maximizes the available gas velocity in the region where the melt stream is atomized. In other words, the close coupling is itself beneficial to effective atomization because there is essentially no loss of gas velocity before the gas stream from the nozzle impacts the melt stream and starts to atomize it.

Because of this relationship of the particle size to the cooling rate, the best chance of keeping a higher concentration of additive elements of an alloy, such as the strengthening additives, in solid solution in the alloy is to atomize the alloy to very small particles. Also, the microstructure of such finer particles is different from that of larger particles and often preferable to that of larger particles.

For an atomization processing apparatus, accordingly the higher the percentage of the finer particles which are produced the better the properties of the articles formed from such powder by conventional powder metallurgical techniques. For these reasons, there is strong economic incentive to produce finer particles through atomization processing.

As pointed out in the commonly owned prior art patents above, the closely coupled atomization technique results in the production of powders from metals having high melting points with higher concentration of fine powder. For example, it was pointed out therein that by the remotely coupled technology only 3% of powder produced industrially is smaller than 10 microns and the cost of such powder is accordingly very high. Fine powders of less than 37 microns in diameter of certain metals are used in low pressure plasma spray applications. In preparing such powders by remotely coupled techniques, as much as 60–75% of the powder must be scrapped because it is oversized. This need to selectively separate out only the finer powder and to scrap the oversized powder increases the cost of useable powder.

Further, the production of fine powder is influenced by the surface tension of the melt from which the fine powder is produced. For melts of high surface tension, production of fine powder is more difficult and consumes more gas and energy. The remotely coupled industrial processes for atomizing such powder have yields of powder of less than 37 microns average diameter from molten metals having high surface tensions of the order of 25 weight % to 40 weight %.

A major cost component of fine powders prepared by atomization and useful in industrial applications is the cost of the gas used in the atomization. Using conventional remotely coupled technology, the cost of the gas increases as the percentage of fine powder sought from an atomized processing is increased. Also, as finer and finer powders are sought, the quantity of gas per unit of mass of powder produced by conventional remotely coupled processing increases. The gas consumed in producing powder, particularly the inert gas such as argon, is expensive.

As is explained more fully in the commonly owned patents referred to above, the use of the closely coupled atomization technology of those patents results in the formation of higher concentrations of finer particles than are available through the use of remotely coupled atomization techniques. The texts of the commonly owned patents are incorporated herein by reference.

As is pointed out more fully in the commonly owned U.S. Pat. No. 4,631,013, a number of different methods have been employed in attempts to produce fine powder. These methods have included rotating electrode process, vacuum atomization, rapid solidification rate process and other methods. The various methods of atomizing liquid melts and the effectiveness of the methods is discussed in a review article by A. Lawly, entitled "*Atomization of Specialty Alloy Powders*", which article appeared in the Jan. 19, 1981 issue of the Journal of Metals. It was made evident from this article and has been evident from other sources that gas atomization of molten metals produces the finest powder on an industrial scale and at the lowest cost.

It is further pointed out in the commonly owned U.S. Pat. No. 4,631,013 patent that the close coupled processing as described in the commonly owned patents produces finer powder by gas atomization than prior art remotely coupled processing.

A critical factor in the close coupled gas atomization processing of molten metals is the melting temperature of the molten metal to be processed. Metals which can be melted at temperatures of less than 1000° C. are easier to atomize than metals which melt at 1500° or 2000° C. or higher, largely because of the degree of reactivity of the metal with the atomizing apparatus at the higher temperatures. The nature of the problems associated with close coupled atomization is described in a book entitled "*The Production of Metal Powders by Atomization*", authored by John Keith Beddow, and printed by Haden Publishers, as is discussed more fully in the the commonly owned U.S. Pat. No. 4,631,013.

The problems of attack of liquid metals on the atomizing apparatus is particularly acute when the more reactive liquid metals or more reactive constituent of higher melting alloys are involved. The more reactive metals include titanium, niobium, aluminum, tantalum, and others. Where such ingredients are present in high melting alloys such as the superalloys, the tendency of these metals to attack the atomizing apparatus itself is substantial. For this reason, it is desirable to atomize a melt at as low a temperature as is feasible.

One of the problems which is associated with efficient atomization of molten metal samples is the effective use of the atomizing gas. In general, it has been found desirable, particularly in the remotely coupled atomization practices, to employ an atomizing gas at as high a pressure as is conveniently available from the pressurized gas source.

In the practice of atomizing molten metal, using closely coupled liquid metal and pressurized gas sources, the preferred practice has been to follow the practice employed in the remotely coupled atomization, and to employ a gas pressure which is as high as is conveniently available from a pressurized gas source.

We have now discovered, however, that increases in gas pressure employed in atomization of liquid metals does not uniformly result in an increased efficiency in the atomization processing. In fact, increases in gas pressure can be shown to be detrimental to the atomization of melts which are of very low superheat.

PRIOR ART

The teachings of the prior art are contrary to our finding that higher atomization efficiency can be achieved at lower atomizing gas pressures.

There are a number of publications which deal with the relationship between gas flow and particle size of particles formed by gas atomization. One such article is authored by G. Rai, E. Lavernia, and N. J. Grant, and is entitled "*Powder Size and Distribution in Ultrasonic Gas Atomization*". The article appeared in the August 1985 issue of the Journal of Metals. In FIG. 4 of this article appearing on page 23, a graph a calculated powder size as a function of pressure for different metal-to-gas ratios is set forth. This graph makes clear that the average powder size is relatively high for low gas pressures of the order of 500 psi or below and that the particle size decreases with increasing pressure of 1500 psi. Also, in FIG. 9 of the same article, a graphical display of calculated and experimental values for the relationship between powder size and pressure is set forth. A clear relationship for both calculated and experimental values is displayed showing decreasing powder size with increasing pressure.

In another article edited by S. Steeb and H. Warlimont, entitled "*Rapidly Quenched Metals*" and appearing in the Proceedings of the Fifth International Conference on Rapidly Quenched Metals, at Wurzburg, Germany, on Sep. 3–7, 1984 there is an article appearing in the Proceedings, authored by Malcolm J. Couper and Robert F. Singer of the Brown Boveri Research Center, in Switzerland, entitled "*Rapidly Solidified Aluminum Alloy Powder Produced by Optimization of the Gas Atomization Technique*". In this article, it is pointed out that recent attempts have been made to reduce powder size in gas atomization by the use of higher gas pressures as well as other techniques. On page 1741 of this article, in Table 2, the yield of powder of less than 50 microns is indicated to be increased through the use of higher gas pressures than are used in conventional atomization.

Further evidence of the relationship accepted in the industry between increasing atomization pressure and decreasing particle size is set forth in an article by V. Anand, A. J. Kauffman, and N. J. Grant, entitled "*Rapid Solidification of a Modified* 7075 *Aluminum Alloy By Ultrasonic Gas Atomization*", appearing in Proceedings of the Second International Conference on Rapid Solidification Processing, at Weston, Va. (March 1980). The Proceedings appeared in a publication entitled "*Rapid Solidification Processing, Principles and Technologies, II*", edited by R Mehrabian, B. H. Kear, and M. Cohen. In FIG. 6 of this article, appearing on page 282, the size distribution analysis of aluminum powders is plotted. The powder size is shown as the abscissa and the cumulative percent of powder retained is shown as the ordinate for a number of different pressures and temperatures. As it is pointed out in the article on page 281, with reference to FIG. 6, that:

> "FIG. 6 shows the range of powder sizes obtained in typical atomization runs for aluminum. Gas pressures (gas velocities) must be high to achieve high yields of –44 micron (325 mesh) powders, and dies must be cleaned, with smooth cavities, etc. Typically, the degree of superheat is very important. The values of 770° C. shown here are, in fact, low compared to commercial practices for aluminum where superheats up to 850°–900° C. are not uncommon." (emphasis added)

The U.S. Pat. No. 4,619,845, also considers the question of the relationship of gas pressure used in atomization and the fineness of the atomized particles produced. In general, the patent favors the use of higher gas pressures in the range of 1000 to 2000 PSIG to achieve supersonic nozzle operation and finer particle production.

Surprisingly, we have found that it is possible to modify an atomization process so that production of a higher percentage of fine particles is feasible without use of higher atomizing gas pressure. In fact, we have found that finer particles can be produced through the use of lower gas pressure. Another advantage of the modified process is that reduced freeze-up of the melt guide tube occurs.

BRIEF STATEMENT OF THE INVENTION

In one of its broader aspects, objects of the invention can be achieved by first providing a supply of molten metal having a melting point of more than 1000° C. The present method involves then providing melt guide means for guiding the melt as a stream to an atomization zone. The melt guide means may be in the form of a tube which is disposed immediately above the atomization zone. Next, a gas supply means is provided as well as means to direct the gas into the atomizing zone to atomize the molten metal passing thereinto from the melt guide means. The gas supply means includes an annular gas manifold at least partially surrounding the lower end of the melt guide means. The gas manifold has an inlet for supply of gas to the manifold, a chamber to distribute gas in the manifold, and an annular orifice to direct streams of gas from said manifold into contact with the molten metal as it enters the atomization zone. Pursuant to the present invention, the cross sectional area of the orifice is increased according to the expression below and the pressure of the gas in the manifold is adjusted to between 200 and 500 psi and the gas to metal ratio is adjusted to between 2 and 6. The expression relating the mass flow of gas, the inner and outer radius of the gas orifice and the pressure is as follows:

$$\dot{m} \cong 124 \frac{(r_o^2 - r_i^2)p}{\sqrt{T}},$$

where:

$\dot{m}$ is the mass flow of gas, $r_o$ is the outside radius $r_i$ is the inside radius, p is the pressure, T is the temperature.

BRIEF DESCRIPTION OF THE DRAWINGS

The description which follows will be understood with greater clarity if reference is made to the accompanying drawings in which.

Figure 1:
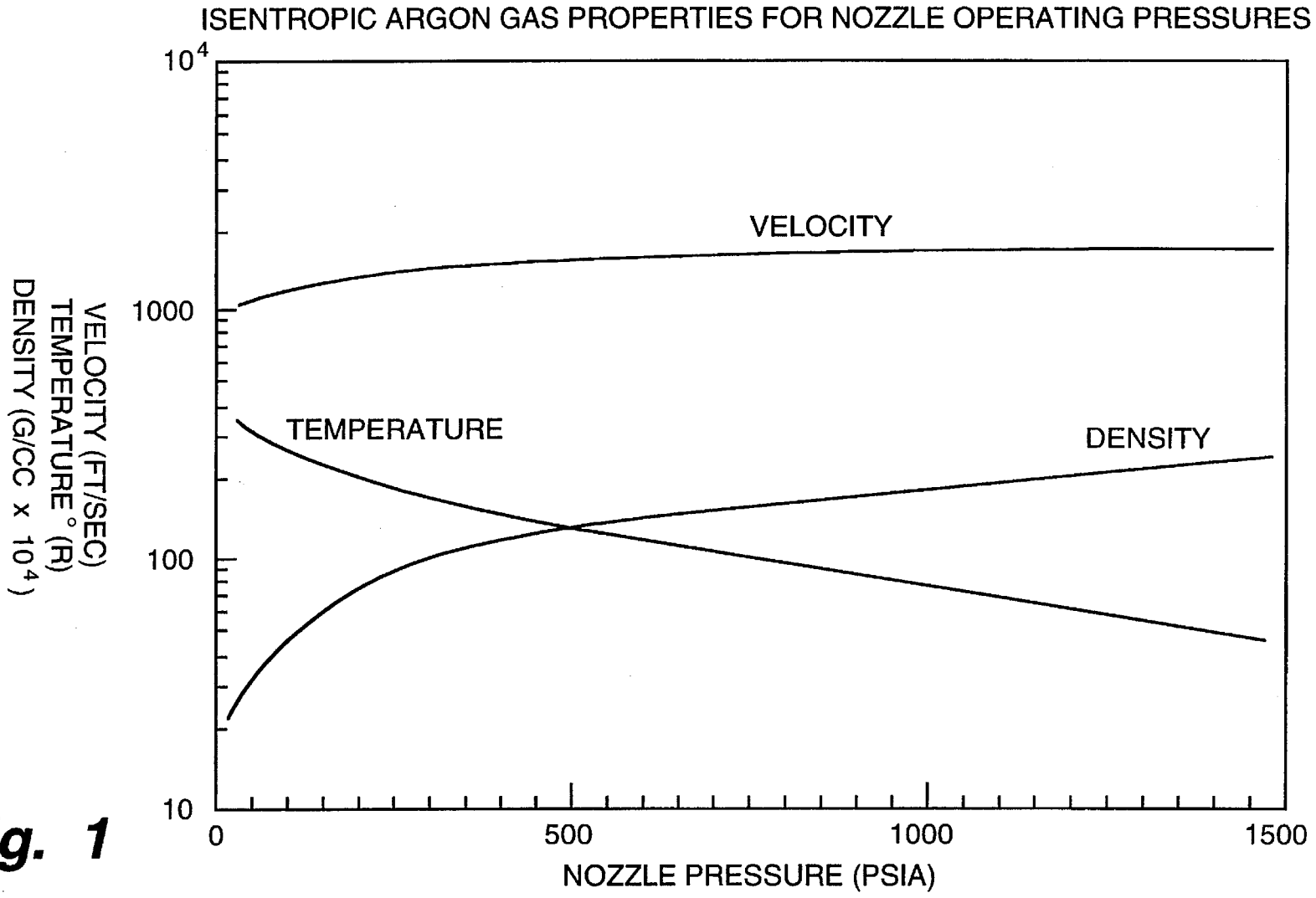
FIG. 1 is a graph in which the velocity, temperature, and density of isotropically expanded argon are plotted as the ordinate and the nozzle pressure in pounds per square inch is plotted as the abscissa.

By functional dependence, as used herein, is meant that where functional dependence is present a mathematical expression can be developed which governs the relationship between two factors such as the yield and gas-to-metal ratio. Also, where functional dependence is absent, no such mathematical expression can be developed.

DETAILED DESCRIPTION OF THE INVENTION

As has been evident from a number of journal articles and other sources, the powder metallurgy industry has been actively driving toward greatly increased usage of fine powders over the past two decades. One of the reasons for this drive is the recognition that superior metallurgical properties are achieved because of the higher solubility of strengthening and similar additives in alloys which are converted into the very fine powder as discussed above. Generally, greater strength, toughness, and fatigue resistance can be attained in articles prepared via the fine powder route for such alloys as compared to the properties found in the same alloys prepared by ingot or other conventional alloy technology. These improvements in properties come about principally due to the extensions of elemental solubility in the solid state which are obtainable via fine powder processing. In other words, the additives preferably remain in solid solution or in tiny nucleated precipitate particles in the host alloy metal and impart the improved properties while in this state as also discussed above. Generally, the finer the powder, the more rapidly it is solidified and the more the solubility limits are extended. In addition, the limits on the alloying additions processed through the fine powder route are increased.

A nemesis of the improved property achieved through fine powder processing however is contamination by foreign materials which enter the powder prior to consolidation. The contamination acts to reduce the local strength, fatigue resistance, toughness, and other properties and thus the contamination becomes a preferred crack nucleation site. Once nucleated, the crack can continue to grow through what is otherwise sound alloy and ultimately results in failure of the entire part.

What is sought pursuant to the present invention is to provide a process capable of manufacture of powder that is both finer and cleaner, and to do so on an industrial scale and in an economical manner.

In order to accomplish this result, one of the problems to be overcome is a reduction in a major source of defects introduced by the prior art conventional powder production process itself. In the conventional powder production process, the alloy to be atomized is first melted in ceramic crucibles and then is poured into a ceramic tundish often by means of a ceramic launder and is finally passed through a gas atomization nozzle employing ceramic components. Where the alloy to be atomized is a superalloy, it is well-known to contain highly reactive components such as titanium, zirconium, molybdenum, and aluminum, among others, and that these metals are highly reactive and have a strong tendency to attack the surfaces of ceramic apparatus which they contact. The attack can result in formation of ceramic particles and these particles can be incorporated into the melt passing through the atomization process and ultimately in the final powder produced by the atomization process. These ceramic particles are a major source of the foreign matter contamination discussed above.

One way in which the conventional extensive use of ceramic containment and ceramic surfaces can be eliminated is through the use of the so-called cold hearth melting and processing apparatus. In this known cold hearth apparatus, a copper hearth is cooled by cold water flowing through cooling channels embedded in the copper hearth. Because the hearth itself is cold, a skull of the metal being processed in the hearth is formed on the inner surface of the hearth. The liquid metal in the hearth thus contacts the skull of solidified metal and contamination of the molten metal by attack of ceramic surfaces is avoided. However, it has now been found that the use of cold hearth processing results in a supply of molten metal which has a very low superheat in comparison to the superheat of metal processed through the prior art ceramic containment devices. The superheat is, of course, a measure of the difference between the actual temperature of the molten alloy melt being processed and the melting point or more specifically the liquidus temperature of that alloy. For apparatus employed in close coupled atomization as described in the commonly owned patents referred to above, higher superheats in the range of 200°–250° C. are employed to prevent the melt from freezing off in the atomization nozzle. For apparatus which is more remotely coupled than that described in these patents, a 150°–250° C. or higher superheat is employed to prevent a melt from excessive loss of heat and freezing during processing.

An important point regarding the processing of melts with low superheats of 50° C. or less is that strengthening and other additives are as fully dissolved in a melt having a low superheat as they are in a melt having a high superheat. Accordingly, improvements in properties of fine powders, of less than 37 micron diameter for example, is found in equal measure in such powders prepared from melts with low superheats as in fine powders prepared from melts having high superheats.

In using a cold hearth containment to provide a reservoir of molten metal for atomization, it has been found that application of heat to the upper surface of the melt is economic and convenient. Such heat may be applied, for example, by plasma arc mechanisms, by electron beam or by other means. Because a melt contained in a cold hearth looses heat rapidly to the cold hearth itself, it has not been possible to generate significant superheat in the melt. Measured superheats of melts contained in cold hearth indicates that time averaged superheats of up to about 50° C. in magnitude are feasible. Where the melts supplied from cold hearth sources have relatively low superheat of the order of 10°–50° C., there is a much higher tendency for such melts to freeze up in atomization apparatus. For this reason, such melts cannot be processed at conventional flow rates to powder having a high percentage of fines through loosely coupled conventional processing equipment which require superheats of 100° C. or more up to 300°–400° C. Similarly, attempts to atomize melts having low superheats of less than 50° C. at conventional flow rates through the closely-coupled atomization apparatus of the commonly owned patents have failed due to freeze-up of the melt in the atomization nozzle.

Figure 3:
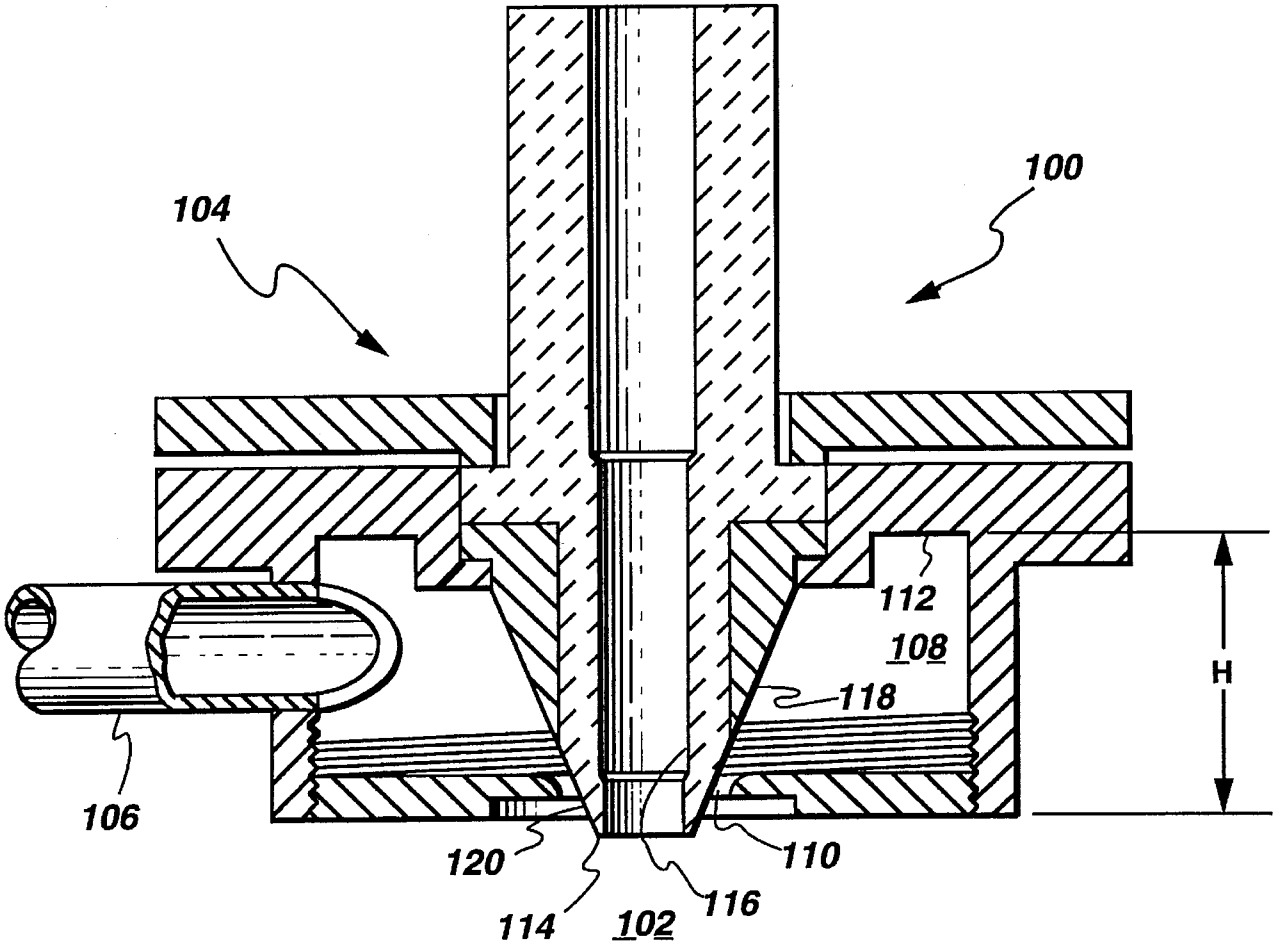
Fig. 3 (PRIOR ART)
FIG. 3 is a sectional view of a prior art close coupled atomization apparatus as described in the literature.

FIG. 3 is a vertical section of a prior art close coupled atomization nozzle as disclosed in commonly owned U.S. Pat. No. 4,631,013 and others referred to above. The mechanism is made up essentially of two parts, the first of which 100 is a melt guide tube for guiding a melt to an atomization zone 102 directly below the lower-most portion of melt guide tube 100. The second portion is gas supply and gas nozzle arrangement 104 which supplies atomizing gas to the atomization zone 102 through a gas inlet 106, a gas plenum 108, and an annular gas orifice 110. 0f particular interest in this mechanism is the vertical distance, H, in which there is a parallel flow of the metal to be atomized and of the atomizing gas. This height, H, shown by the arrow on the right-hand side of the figure illustrates the vertical component of the gas flow from the top 112 of plenum 108 to the bottom 114 of the melt guide tube 100 against which the gas flows both within the plenum 108 and as it exits the plenum through orifice 110.

The height, H, also illustrates the height of the column of liquid metal within the bore 116 of melt guide tube 100 which is in parallel flow with the vertical component of gas flow through the plenum 108 and orifice 110. The gas from pipe 106 expands into plenum 108 and expands further as it leaves orifice 110. In both expansions the gas is cooled spontaneously and removes heat from the gas shield 118 and from the inwardly tapered surface 120 of the lower end of melt guide tube 100.

One aspect of improving the start-up of close coupled atomization is a reduction in the height, H, over which there is a parallel flow of atomizing gas and melt to be atomized.

An apparatus suitable for practice of the the invention is now described with reference to FIGS. 1 and 2.

Figure 2:
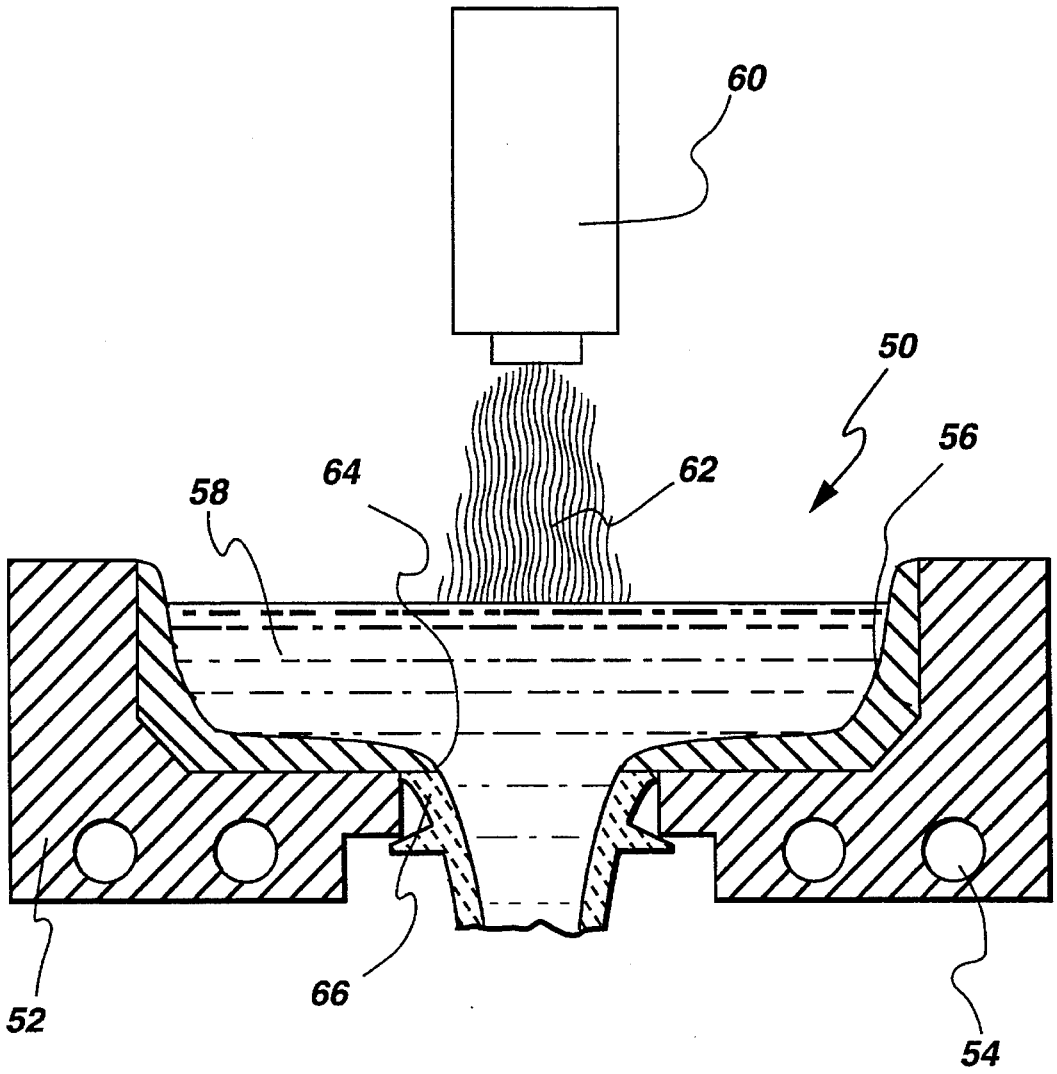
FIG. 2 is a semischematic sectional view of the lower portion of a melt supply apparatus and the upper portion of a melt guide tube associated with the apparatus.

Reference is made first to FIG. 2. In FIG. 2 a melt supply reservoir and the upper portion of a melt guide tube are shown semischematically. The figure is semischematic in part in that the hearth 50 and tube 60 are not in size proportion in order to gain clarity of illustration. The melt supply is from a cold hearth apparatus 50 which is illustrated undersize relative to tube 66. This apparatus includes a copper hearth or container 52 having water cooling passages 54 formed therein. The water cooling of the copper container 52 causes the formation of a skull 56 of frozen metal on the surface of the container 52 thus protecting the copper container 52 from the action of the liquid metal 58 in contact with the skull 56. A heat source 60, which may be for example a plasma gun heat source having a plasma flame 62 directed against the upper surface of the liquid metal of molten bath 58, is disposed above the surface of the reservoir 50. The liquid metal 58 emerges from the cold hearth apparatus through a bottom opening 64 formed in the bottom portion of the copper container 52 of the cold hearth apparatus 50. Immediately beneath the opening 64 from the cold hearth, the top of a melt guide tube 66 is disposed to receive melt descending from the reservoir of metal 58. The top portion of tube 66 is illustrated oversize relative to hearth 50 for clarity of illustration.

The melt guide tube 66 is positioned immediately beneath the copper container 52 and is maintained in contact therewith by conventional means not shown to prevent spillage of molten metal emerging from the reservoir of molten metal 58 within the cold hearth apparatus 50. The melt guide tube 66 is a ceramic structure which is resistant to attack by the molten metal 58. Tube 66 may be formed of boron nitride, aluminum oxide, zirconium oxide, or other suitable ceramic material. The molten metal flows down through the melt guide tube to the lower portion thereof from which it can emerge as a stream into an atomization zone.

We have studied the operation of an apparatus as described above and have discovered unique operating principles. In particular we have found that superior results are achieved when this and any close coupled apparatus is operated with lower pressure atomizing gas rather than with higher pressure atomizing gas.

We have made measurements of the pressure and of the other parameters of the flow of gas to an atomization zone of an atomization apparatus and we have also measured and altered several of the parameters relating to the atomization apparatus itself. From these studies, we have determined that for a close coupled atomization structure having a relatively larger atomizing gas orifice, the increase in the pressure of atomizing gas does not yield a significant increase in atomizing effectiveness above a measured pressure value in the order of 200–500 pounds per square inch.

In other words, what we have discovered is that there is a novel relationship which concerns the effectiveness of the atomization process and which involves two interdependent parameters. One parameter is the mass flow of gas to the atomization zone. The second parameter is the pressure of the gas in the gas plenum as it passes to the gas orifice and into the atomization zone.

In essentially all prior art atomization processes in which an effort is made to increase the mass flow of gas to the atomization zone, this effort is made by increasing the pressure of the gas supplied to the atomization nozzle. We have discovered that while it is important to increase the mass flow of gas to the atomization zone, we have also discovered that this can be accomplished by increasing the size the gas orifice as well as by controlling the pressure of the gas and that the optimum combination of pressure and mass flow of gas is one in which the pressure is maintained below 500 psi and the mass flow of gas to the atomization zone is increased by increasing the open cross sectional area of the gas orifice.

Accordingly, in the description which follows, while emphasis is placed on the higher temperature and lower velocity and density of gas supplied to the atomization zone it will be understood that there is also an accompanying increase in the mass flow of gas to the atomization zone but that the increased mass flow is not accomplished by the conventional practice of an increase of the pressure of the gas which is supplied to the atomization nozzle.

Some of the relationships and factors of the various parameters of this study are now discussed with reference to accompanying FIG. 1. In this figure, the pressure is plotted as abscissa and the density, temperature, and velocity of the gas are separately plotted as ordinate. With reference to the three parameters plotted in FIG. 1, it is evident that the ordinate is plotted on a logarithmic scale and that the abscissa is plotted on a linear scale. The separate values for the three plots on FIG. 1, which are individually labeled as velocity, temperature, and density, are given in the left margin. The velocity is plotted in feet per second on a logarithmic scale. Temperature is plotted in Rankin (R) which is the British equivalent of Kelvin. Density is plotted in grams per cubic centimeter with a multiplier of $10^{-4}$. The single logarithmic numerical scale starting with 10 at the bottom and progressing to 100, 1000, and 10,000 in equal increments are the values of each of the three separately plotted parameters of the graph of FIG. 1.

The values of the gas parameters plotted in this figure are for argon gas when it is isentropically (or reversibly and adiabatically) expanded from the nozzle pressure shown in the graph to a freely flowing jet at ambient pressure. As used herein, the term nozzle pressure refers to the pressure of the gas as supplied to the nozzle and as measured at the plenum of the nozzle and not to the pressure of the gas passing through or exiting the nozzle. The values plotted for temperature and velocity are values for the gas as it passes through the nozzle as a free flowing jet. Argon is the most commonly used atomization gas. Similar relationships exist for all other gases.

One of the relationships found from this study is that the temperature of the atomizing gas jet declines as the pressure of the gas in the nozzle plenum is increased. The temperature of the gas at the point of atomization is, of course, the result of the gas having expanded from its high pressure condition to a lower pressure condition in which it impacts the molten metal. Accordingly, as the pressure of the gas supplied is increased, there is a greater pressure drop as the gas is released in a stream which impacts the molten metal and a rough plot of the relationship of pressure to temperature is shown in the diagonal line, labeled "Temperature", extending from the midleft to the lower right portion of the graph.

It will be observed regarding the temperature plot of FIG. 1 that the gas temperature continuously decreases with increasing plenum pressure.

It is also evident from FIG. 1 and particularly from the plot of density labeled as such that the greatest rate of increase in density occurs below about 500 psia. This is evident from the curved portion of the plot to the left of the 500 psia location on the plot. Above about 500 psia the density plot is essentially straight lined. It is well-known that as the temperature of a gas is decreased and as the density of a gas is increased, its ability to conduct heat and to convect heat away from a surface which it contacts and over which it passes is also increased.

FIG. 1 shows that by using increased gas pressures, both the gas temperature and density are changed in a direction that adversely influence heat transfer from the melt stream and promote the likelihood of metal freeze-off. What we have found from this study is that it is generally desirable to reduce the pressure of the gas inasmuch as a reduction in the pressure of the gas results in a higher gas temperature and lower density in the flowing gas and a reduction in the rate at which heat is withdrawn from the flowing metal stream.

In order to obtain sufficient mass gas flow for efficient atomization, the cross sectional area of the orifice is increased. This makes possible a greater mass flow of gas to the atomization zone without an increase in gas pressure. Further, as the orifice is enlarged, a proportionably smaller fraction of the gas which passes through the orifice contacts the gas shield or the lower end of the melt guide tube.

Another plot of FIG. 1 is the graph labelled "Velocity" representing the velocity of the gas in relation to the pressure of the gas supplied. For an atomization structure having a relatively larger atomization gas nozzle, we have found, as is displayed in FIG. 1, that there is no significant increase in the velocity of the gas impacting the molten metal after the pressure has increased above about 500 psia (pounds per square inch absolute). In fact, a very significant fraction of the velocity at 500 psia is developed under a gas pressure of 200 to 300 psia. Above this value, the velocity rapidly plateaus. Thus, continuously increasing the gas pressure does not provide corresponding increases in the gas velocity. Thus, to optimize the atomization process one needs to choose a gas pressure which provides adequate gas velocity for stream disintegration, but is not so high that excessive heat extraction from melt stream occurs. This optimization occurs in range of 300–600 PSIG. It should be noted that some conventional atomization practices employ gas pressure of up to 1500 psi as it has generally been thought that increased pressure resulted in increased atomization efficiency. This is explained in the discussion of the prior art given above.

The importance of the trends identified in FIG. 1 are accurately quantified by the following two expressions, A and B, governing:

(A) liquid droplet instability in a flowing gas, and (B) convective heat transfer respectively.

These expressions are as follows:

$$We = \frac{\rho V^2 D}{\sigma} \geqq 10. \quad \text{(A)}$$

As indicated above, in this expression,

We is the Weber number;

$\rho$ is the density of the gas;

V is the gas velocity;

$\sigma$ is the surface tension of the liquid metal; and

D is the droplet diameter.

The significance of this expression in relation to our experimental findings is as follows. The numerator describes the shearing energy per unit area exerted on the liquid by the flowing gas. It is this shear which will cause the liquid to disrupt and be atomized into droplets. The denominator, the surface tension of the metal, is the energy trying to maintain the integrity of the liquid body and hence is the energy barrier resisting atomization. As noted above, when this ratio exceeds approximately 10 the liquid body becomes unstable and is atomized by the flowing gas.

The above expression, combined with FIG. 1 clearly demonstrates that when increases in pressure no longer result in significant increases in gas velocity, those increases in pressure do not contribute to improved atomization.

Similarly, the manner in which the use of increased gas pressures results in increased heat transfer between the melt guide tube and the gas is given by the following linear expression for convective heat transfer:

$$Q = HA(\Delta T), \quad \text{(B)}$$

where:

Q is the convective heat flux,

H is the interface coefficient of heat transfer,

A is the surface area, and $\Delta T$ is the difference between the surface temperature and the temperature of the flowing gas.

As shown by FIG. 1, increased gas pressure results in lower gas temperature, and hence a greater $\Delta T$. It also results in an increased gas density and as a result a higher effective heat transfer coefficient H. Both of these lead to an increase in the convective heat flux and cause increased cooling of the metal stream contained in the melt guide tube. This condition of increased heat flux leads to the requirement of high melt superheats to prevent freeze-off. In situations where melt superheats are low the convective heat loss from the melt will cause rapid cooling and freezing of the metal stream.

Accordingly, from these two expressions, it is evident that increases in pressure of gas used in close coupled atomization above certain values, as outlined above, does not increase the effectiveness of atomization but does increase the likelihood of freeze-up.

Applicants have found that values for the surface area range between about 0.025 to about 0.75 inches square, preferably from about 0.025 to about 0.15 inches square, and most preferably between about 0.03 and about 0.10 inches square.

Figure 4:
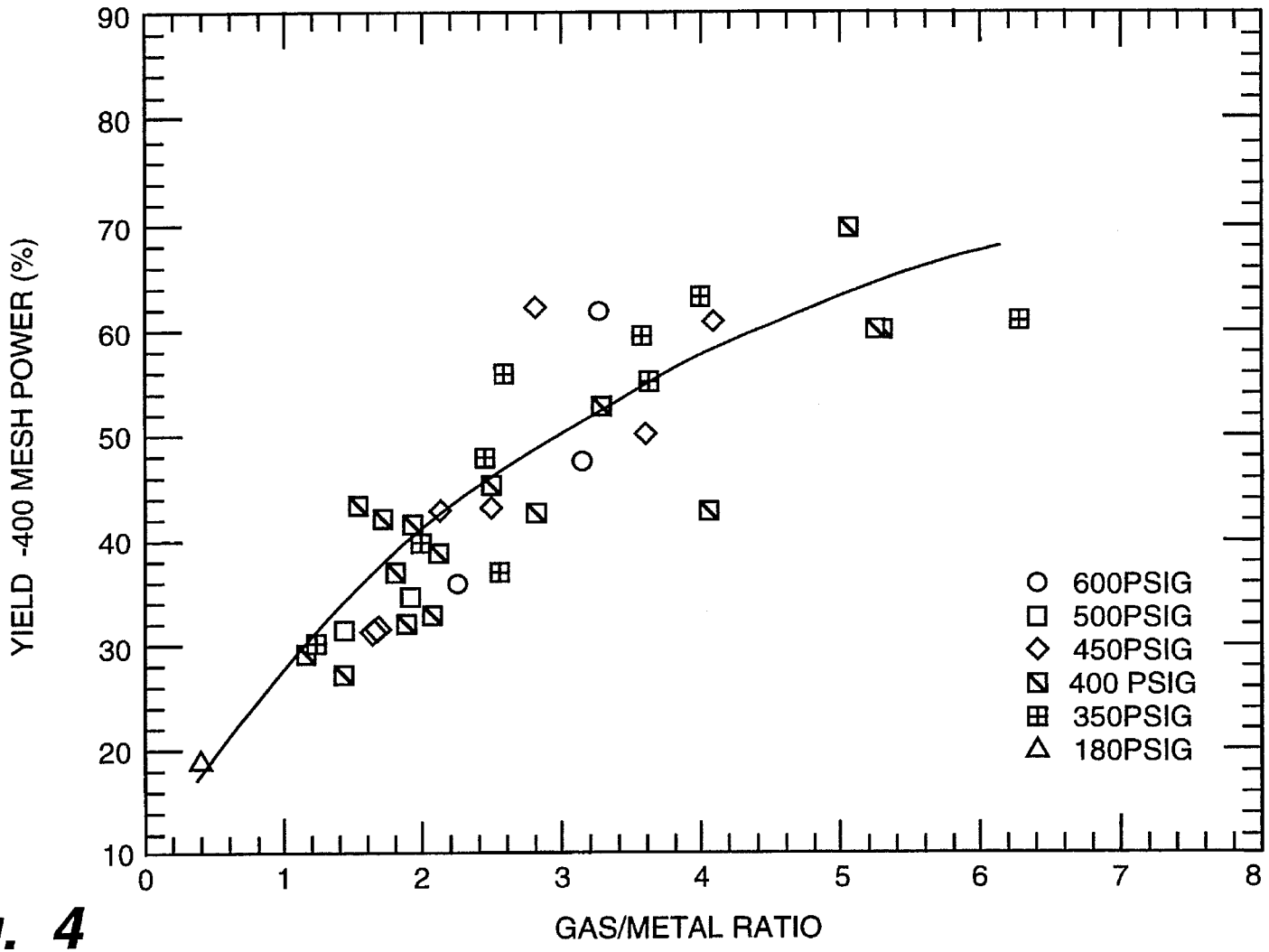
FIG. 4 is a graph showing the clear functional dependence of the yield of –400 mesh powder on the gas to metal ratio.

Referring now next to FIG. 4, this figure is a graph in which the percent yield of −400 mesh (−37 micron) powder is plotted against the gas to metal ratio, plotted as abscissa for a number of different pressures as listed in the legend of the figure. The figure reveals two important results. The first is that the yield of fine powder is mainly controlled by the gas-to-metal ratio employed and not soley by the gas pressure employed. The yield of –400 mesh powder is seen to increase with increased gas to metal ratios. Secondly, there is no correlation between yield and the atomization gas pressure.

We have found that in the practice of the cold hearth melting and the use of low superheat melts in close coupled atomization, it is preferable to use low gas pressure of 600psia or less. We have further found that, as the pressure is reduced and the temperature is reduced as a consequence, the convective heat flux is also reduced.

Figure 5:
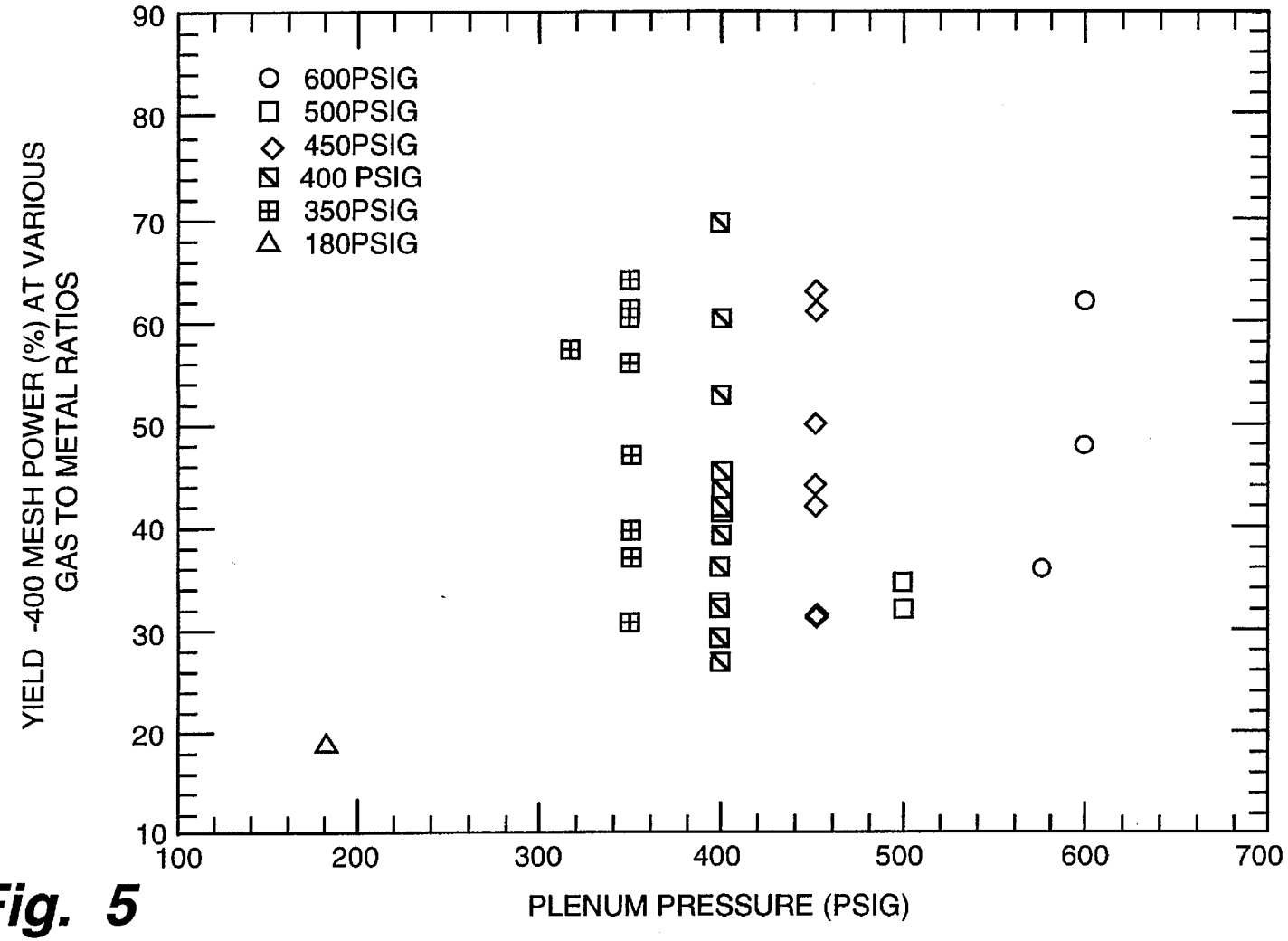
FIG. 5 is a graph showing the absence of functional dependence of yield on plenum pressure.

The prior art teaching on this subject is that in order to produce fine powder, a high pressure is necessary as has been discussed in the section on the prior art set forth above. However our data shows that the high pressure is not important and this is brought out in the data plotted in FIG. 5. FIG. 5 shows there is no relationship between the yield of –400 mesh powder and the plenum pressure employed. FIGS. 4 and 5 demonstrate that the controlling factor in the determination of the yield of fine powder produced is the gas to metal ratio, g/m, and is not the gas pressure. FIG. 5, which shows the results of changing the plenum pressure, as well as the gas to metal ratio at each plenum pressure, demonstrates that for an atomization apparatus with a larger gas orifice, a change in the gas pressure alone has essentially no influence on the yield of –400 mesh powder produced. FIG. 4 shows that a change in the gas to metal ratio directly affects the yield of fine powder which can be produced and that the yield of –400 mesh powder produced is independent of changes in gas pressure.

From our work in studying the interrelation of various factors concerned with close coupled atomization, it is our conclusion that the gas to metal ratio is a vital factor in the achievement of a high percentage of fine particles through close coupled atomization. Further, it is our conclusion that the observations which others have made concerning the benefits of greatly increased pressure as outlined in the statements of the prior art above are misdirected. In particular, the benefits which are achieved from the use of the higher pressure are due more to increased mass gas flow rate, and consequently increased gas to metal ratio, at such high pressures rather than from increased pressure and correspondingly minor increased gas velocity. We have concluded, based on the dynamic gas properties such as that plotted in FIG. 1, and the relationship governing flow rate for an isentropically expanded gas, that the conclusion that there is an increased yield as a result of increased pressure alone is an erroneous prior art conclusion which is not supported by our experimental data.

This can be in part explained by the relationship which governs the mass flow rate of gas at supersonic flow conditions. The expression of this relationship and the relevant factors of the expression are as follows:

$$\dot{m} = AP\sqrt{\frac{Kg_c}{TR}} \times \left(\frac{K+1}{2}\right)^{\frac{K+1}{2(1-K)}}$$

where:

$\dot{m}$=mass flow rate in lbs/min,

A=gas orifice area in square inches,

P=pressure inpsia,

T=temperature in degrees Rank in,

R=gas constant,

K=specific heat ratio, $g_c$=constant.

It is apparent from the relationships of this expression that two key means of increasing the mass flow rate are to increase the pressure of the atomization gas and to increase the gas orifice area. In fact, flow rate is linearly related to both A and P, and a doubling in either the area, A, or the pressure, P, will double the resultant flow rate. As an example, if one doubles the operating pressure from 750 to 1500 psia the gas velocity increases from about 1660 to 1780 ft/sec, the result is that a doubling of the pressure leads to only about a 7% improvement in gas velocity while the total gas passing through the orifice will increase by 100%.

From the foregoing example, it is evident that the prior art primary reliance on increasing pressure to increase atomization effectiveness through increased gas velocity has been misdirected. In the above expression as applied to atomization the gases of interest are argon, nitrogen, helium and air.

In the above expression, the value of A in square inches is independent of gas orifice configuration. In the special case where the gas orifice has an annular shape, the expression can be written in a different form as stated below.

For close coupled atomization employing argon atomizing gas and an annular nozzle design, the relationship of the mass flow rate, $\dot{m}$, to the area and pressure variables of an atomization process can be stated in accordance with the following expression:

$$\dot{m} \cong 124\frac{(r_o^2 - r_i^2)p}{\sqrt{T}},$$

where $\dot{m}$ is the mass flow rate in lbs/min, $r_o$ is the outside radius of the annular gas orifice in inches, $r_i$ is the inside radius of the annular gas orifice in inches, p is the pressure in psia, 124 is a constant, and T is temperature in degrees Rankin.

What we have determined to be the critical relationship for close coupled atomization employing argon atomizing gas and an annular gas orifice is to keep the pressure below about 600 psia and to increase the gas orifice opening in accordance with the relationship stated immediately above. Accordingly, pursuant to this expression, the $r_o$ is the outside radius of the annular gas orifice itself and the $r_i$ is the inside radius of the annular gas orifice itself so that whether the inside radius of the annular gas orifice is relatively small or whether it is relatively large, is not of critical concern. Rather, what is of critical concern is that the area of the orifice be established so that the outer radius $r_o$ and the inner radius $r_i$ and the pressure p be such that the gas to metal ratio is in the range of approximately 2–5 while the pressure itself is below about 600 psia.

The significance of this relationship is that where the pressure p is known and is at a value between approximately 200 and 600 psia and where the $r_i$ is known for a particular close coupled atomization apparatus and where the $\dot{m}$ is known and is at a set value, then the expression can be solved for $r_o$ to determine the outside radius for the atomization apparatus. Once the $r_o$ has been determined and where the metal flow rate is maintained constant, the flow rate for the gas can be set so that the gas to metal ratio is in the range of about 2 to 6.

As used in the expression above, applicants have found that values for $r_o$, the outside radius of the annular gas orifice in inches is between about 0.130 and about 0.7 inches, preferably between about 0.160 and about 0.260 inches, between about 0.260 and about 0.360 inches, or between about 0.360 and about 0.460 inches. The value for $r_i$, the inside radius of the annular gas orifice in inches is preferably from about 0.100 to about 0.500 inches.

Accordingly, from the foregoing, it is apparent that by use of the teaching contained herein the several factors which control the effectiveness of a gas atomization process can be determined and established. These factors include:

A. the mass flow of gas which results from the pressure and the area of the orifice;

B. the open area of the atomization orifice and, where the orifice is annular, the outer radius and inner radius of an annular orifice;

C. the pressure of the atomizing gas;

D. the gas to metal ratio of the atomization apparatus;

E. the character of the atomizing gas (conventionally this is argon gas); and

F. the close coupling of the gas orifice to the melt orifice.

Based on the identification and quantification of these factors, a set of operating parameters can be chosen to satisfy the expressions above relative to weber number, heat flux, mass flow rate and orifice area. The adjustment of these operating parameters can result in production of powder of desired fineness with highest efficiency and at the lowest cost.

One important advantage made possible by the present invention is that it greatly reduces the cost of the gas equipment which must be used in connection with atomization processing. The reason for this is that the gas employed in the atomization pursuant to this invention is supplied at a lower pressure than gas used in the prior art devices, such as those described in the background prior art statement of this application above. In supplying gas, the gas itself comes from a tank and the tank must be at a higher pressure than the pressure at which the gas is employed in the atomization.

Where the atomizing gas pressure is 1500 PSIG, this pressure must be maintained through the entire atomization run. To do so, the pressure in the supply tank must be at 1500 PSIG at the end of the run and must be at an even higher pressure at the start of the run.

Where the pressure, which must be maintained during the whole atomization is at a higher level of 1500 PSIG, then the initial supply of gas must be at a very high level of the order of 6000 to 10,000 PSIG. However, where the gas employed can be at the lower levels of less than 600 psi, as made possible pursuant to the present invention, the initial gas pressure need not be at the very high level and may be at a substantially lower level OF ~2000 PSIG. The importance of this initial gas pressure to the cost of processing is that the cost of gas equipment is quite high. The need to supply a very high pressure of gas of the order of 1000 or 1500 psi during an entire atomization run means that the equipment required is very expensive equipment.

Gas handling equipment is expensive, and the price increases with increasing pressure. The standard pressure rating of commercially available storage tanks is 2,400 PSIG. If this is insufficient to supply the total required gas, then specialty tanks must be used at increased cost, with a 3500 and 6000 PSIG tanks being an approximate three times increase in cost per pound of argon. Also of note is that if the atomization pressure is 1500, PSIG vs 500 PSIG almost three times as much gas is retained in the cylinder and is unusable for atomization, further raising costs.

By contrast, in operating at a pressure of about 500 psi or less, as is highly recommended in carrying out the present invention, the initial pressure need not be at a very high level, but may be at a substantially lower level of approximately 1500 or 2000 psi. In addition, the final pressure at the end of the run can be in the range of about 500 psi or less.

Another important benefit concerned with the practice of the present invention is that because the gas is employed at a lower pressure the amount of expansion of the gas to arrive at the 500 psi value is relatively lower than the expansion which occurs when gas expands from a 1500 psi or higher value. Because of the lower degree of expansion of gas, there is actually less heat taken from the apparatus as the atomization process is in progress. Because of this lower withdrawal of heat in the expanding gas, there is less tendency of the apparatus to freeze up during the atomization process. As is indicated above, a freeze up is a significant problem in operation of atomization of liquid metal atomization apparatus.

What is claimed is:

1. A method for close coupled gas atomization of metals having melting temperatures above 1000° C. comprising the steps of:

providing means for supplying a melt to be atomized;

providing melt guide tube means for guiding the melt into an atomization zone;

providing gas supply means for directing atomizing gas into the atomization zone to atomize the melt flowing thereinto from the melt guide tube;

the gas supply means including a gas plenum, at least partially surrounding the melt guide tube, for supplying gas to an orifice;

setting the dimensions of the orifice to satisfy the equation:

$$\dot{m} = AP\sqrt{\frac{Kg_c}{TR}} \times \left(\frac{K+1}{2}\right)^{\frac{K+1}{2(1-K)}}$$

where:

$\dot{m}$=mass flow rate in lbs/min,

A=gas orifice area in square inches,

P=pressure in psia,

T=temperature in degrees Rankin,

R=gas constant,

K=specific heat ratio, $g_c$=gravitational constant;

adjusting the pressure of the atomizing gas in the plenum to between about 200 and about 600 psia; and adjusting the gas to metal ratio to between about 2 and about 6 so that a high percentage of −400 mesh powder is produced.

2. The method of claim 1, wherein A is between about 0.025 and about 0.75 inches square.

3. The method of claim 1 in which A is between about 0.025 and about 0.15 inches square.

4. The method of claim 1 in which A is between about 0.03 and about 0.10 inches square.

5. The method of claim 1, wherein P is between about 300 and about 600.

6. The method of claim 1, wherein the gas to metal ratio is between about 2 and about 5.

7. The method of claim 1, in which the gas to metal ratio is between about 3 and about 5.

8. The method of claim 1, wherein the gas to metal ratio is about 5 and the pressure is about 500 psia.

9. The method of claim 1, wherein the gas to metal ratio is between about 4 and about 5 and the pressure is between about 400 and about 500 psia.

10. A method for close coupled gas atomization of metals having melting temperatures above 1000° C. comprising the steps of:

providing means for supplying a melt to be atomized;

providing melt guide tube means for guiding the melt into an atomization zone;

providing gas supply means for directing atomizing gas into the atomization zone to atomize the melt flowing thereinto from the melt guide tube, the gas supply including a gas plenum at least partially surrounding the melt guide tube, for supplying gas to an orifice, setting the dimensions of the orifice to satisfy the equation for argon gas:

$$\dot{m} \cong 124 \frac{(r_o^2 - r_i^2)p}{\sqrt{T}},$$

where:

$\dot{m}$ is the mass flow of gas,
$r_o$ is the outside radius
$r_i$ is the inside radius,
p is the pressure,
T is the temperature;

adjusting the pressure of the atomizing gas to be directed into the atomization zone to between about 200 and about 700 psia; and adjusting the gas to metal ratio to between about 2 and about 6 so that a high percentage of –400 mesh particles are produced.

11. The method of claim 10 wherein $r_o$ is between about 0.130 and about 0.7 inches.

12. The method of claim 10 in which $r_o$ is between about 0.160 and about 0.260 inches.

13. The method of claim 10 in which $r_o$ is between about 0.260 and about 0.360 inches.

14. The method of claim 10 wherein $r_o$ is between about 0.360 and about 0.460 inches.

15. The method of claim 10 wherein $r_i$ is between about 0.100 and about 0.500.

16. The method of claim 10 wherein P is between about 300 and about 600 PSIG.

17. The method of claim 10 wherein the gas to metal ratio is between about 2 and about 5.

18. The method of claim 10, in which the gas to metal ratio is between about 3 and about 5.

19. The method of claim 10, wherein the gas to metal ratio is about 5 and the pressure is about 500 psia.

20. The method of claim 10, wherein the gas to metal ratio is between about 4 and about 5 and the pressure is between about 400 and about 500 psia.

21. A method for atomization of a molten metal having a high melting point comprising the steps of:

providing atomizing apparatus having close coupled atomization structure of relatively shallow dimensional area;

providing an annular atomization nozzle of said close coupled structure having a melt orifice dimension of at least 0.034 square inches; and supplying atomizing gas to said nozzle at a pressure of between 200 and 600 pounds per square inch gauge; and adjusting the gas to metal ratio to between about 2 and about 6 so that a high percentage of –400 mesh particles are produced.

* * * * *